US008220266B2

(12) United States Patent
Smith

(10) Patent No.: US 8,220,266 B2
(45) Date of Patent: Jul. 17, 2012

(54) CONDENSER FOR POWER PLANT

(75) Inventor: Gordon Raymond Smith, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 783 days.

(21) Appl. No.: 12/402,579

(22) Filed: Mar. 12, 2009

(65) Prior Publication Data

US 2010/0229553 A1 Sep. 16, 2010

(51) Int. Cl.
*F01K 13/02* (2006.01)
*F28B 7/00* (2006.01)

(52) U.S. Cl. ..... 60/646; 60/657; 60/690; 60/693

(58) Field of Classification Search ..... 60/685, 60/687, 690, 693, 646, 657
See application file for complete search history.

(56) References Cited

U.S. PATENT DOCUMENTS 3,831,667 A * 8/1974 Kilgore et al. ..... 165/96
3,881,548 A * 5/1975 Budenholzer ..... 165/110
4,156,349 A * 5/1979 Silvestri, Jr. ..... 60/692
4,347,705 A * 9/1982 Mirante ..... 60/651
4,400,947 A * 8/1983 Ruhemann ..... 60/648
4,506,508 A * 3/1985 Coers et al. ..... 60/652
4,598,767 A * 7/1986 Saleh ..... 165/113
6,481,208 B1 * 11/2002 Nadig ..... 60/687

* cited by examiner

*Primary Examiner* — Hoang Nguyen
(74) *Attorney, Agent, or Firm* — Cantor Colburn LLP

(57) ABSTRACT

A condenser is provided and includes a body into and through which steam turbine discharge is able to flow, and first and second cooling members disposed in the body, wherein the first and second cooling members are each independently receptive of first and second coolant, respectively, the first cooling member, being receptive of the first coolant, is configured to cool the discharge during at least a first cooling operation, and the second cooling member, being receptive of the second coolant, is configured to cool the discharge during a second cooling operation.

20 Claims, 2 Drawing Sheets

CONDENSER FOR POWER PLANT

BACKGROUND OF THE INVENTION

The subject matter disclosed herein relates to a condenser for a power plant.

In combined cycle power plants, a gas turbine engine generates power from the heat generated by the combustion of fuel and air. The heat is then reused to generate additional power as a result of the generation of steam that is introduced into steam turbines. Steam turbine discharge is then condensed in a condenser. Generally, such a condenser includes a body through which steam turbine discharge flows over cooling members and in which condensation occurs.

Currently, many combined cycle power plants are operated and shut down in cycles to save fuel and energy costs during period of low power requirements, such as nights and weekends. As such, the combined cycle power plants need to go through start-up operations frequently in accordance with their respective schedules and, in some cases, in response to unexpected power requirements. Start-up operations are, however, inefficient and time consuming so it is typically a goal of power plant designers to shorten start-up times as much as possible.

As an example, some combined cycle power plants are now maintained with ready-start conditions during shut down times. Ready-start conditions refer to several power plant characteristics including, but not limited to, the ability of a combined cycle power plant condenser to cool steam turbine discharge during shut down times. Steam discharge during shutdown is often limited to a small amount used for sealing the steam turbine against air ingress while the condenser is under vacuum. With that said, the cooling members of the condenser are generally ill equipped to condense the reduced quantities of steam turbine discharge that is produced during the shut down times. Because the normal condenser coolant pump is generally sized for 33% to 100% full steam flow, the need to run a pump to pump coolant to the cooling members during the shut down times is costly and inefficient. Due to the sizing of the condenser cooling members (tube bank) for full cooling water flow, flow from a small pump, although thermodynamically sufficient for cooling the shutdown steam flow, will not distribute evenly within the tube bank. The uneven distribution means some shutdown steam will not be cooled leading to excess temperature and pressure in the condenser.

BRIEF DESCRIPTION OF THE INVENTION

According to one aspect of the invention, a condenser is provided and includes a body into and through which steam turbine discharge is able to flow, and first and second cooling members disposed in the body, wherein the first and second cooling members are each independently receptive of first and second coolant, respectively, the first cooling member, being receptive of the first coolant, is configured to cool the discharge during at least a first cooling operation, and the second cooling member, being receptive of the second coolant, is configured to cool the discharge during a second cooling operation.

According to another aspect of the invention, a power plant is provided and includes a condenser body, into and through which steam turbine discharge is able to flow and in which first and second cooling members are disposed, the first and second cooling members each being independently receptive of first and second coolant, respectively, and configured to respectively cool the steam turbine discharge during at least a first cooling operation and a second cooling operation, a coolant source, a first pump, coupled to the coolant source and the first cooling member, which is configured to pump the first coolant to the first cooling member during at least the first cooling operation, and a second pump, coupled to the coolant source and the second cooling member, which is configured to pump the second coolant to the second cooling member during the second cooling operation.

According to yet another aspect of the invention, a method of operating a power plant, including a condenser body through which steam turbine discharge is able to flow, is provided and includes supplying a first coolant to a first cooling member disposed within the condenser body to cool the steam turbine discharge during at least a first cooling operation, supplying a second coolant to a second cooling member disposed within the condenser body to cool the steam turbine discharge during a second cooling operation, timing a duration of each of the first and second cooling operations, and alternating an engagement of the first and second cooling operations in accordance with the timing, preselected scheduling and current conditions.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
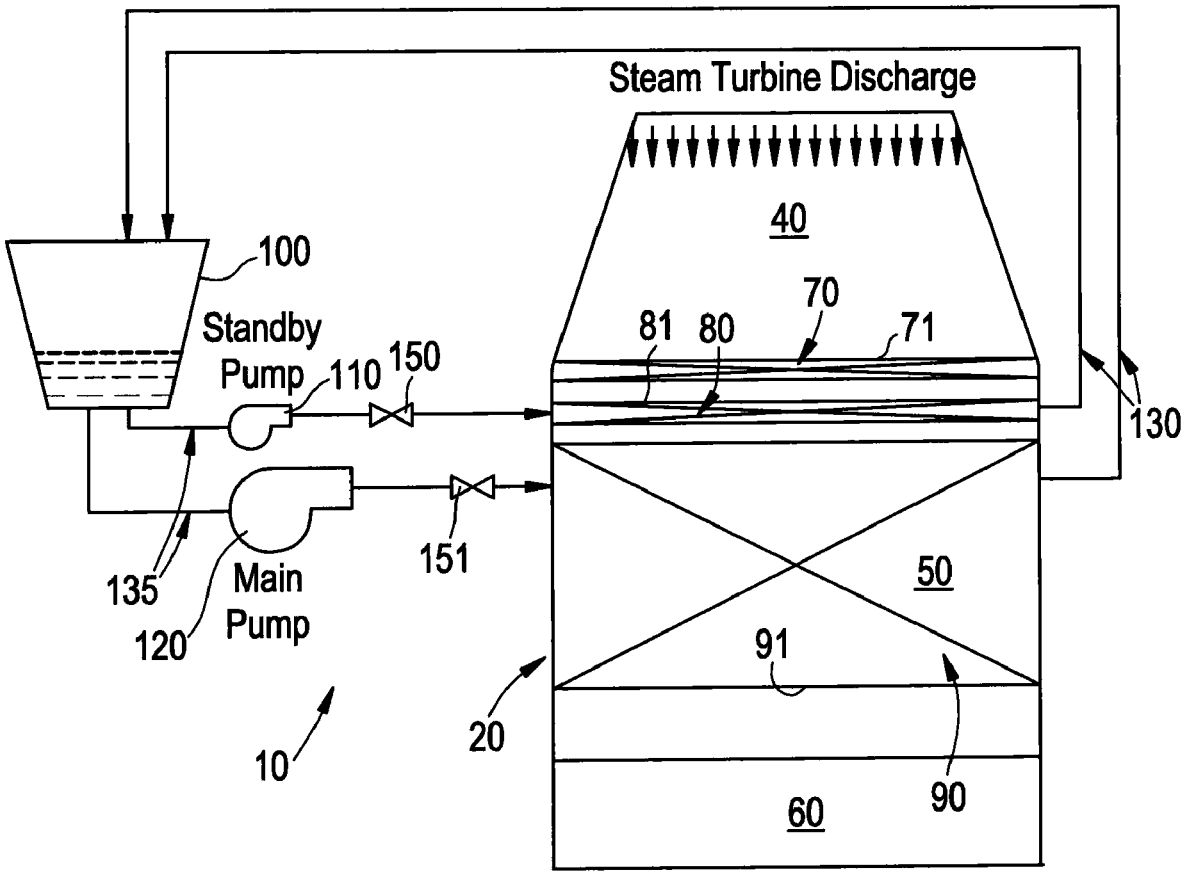
FIG. 1 is a schematic diagram of a combined cycle power plant.

With reference to FIG. 1, a steam cycle cooling subsystem for a combined cycle power plant or any other plant employing a steam cycle 10 is provided. The power plant 10 includes a gas turbine engine and a steam turbine or other means of generating steam. The steam turbine generates power from steam and produces steam turbine discharge, such as excess steam, that is condensed. In the case of a combined cycle power plant, as will be described below, the power plant 10 is able to operate continuously or in cycles of active and shut down states with relatively fast start-up characteristics. The power plant 10, being fast start capable, requires less time to achieve a significant load in the active state and is therefore more efficient.

For the steam turbine discharge to be condensed during normal conditions, the power plant 10 includes a condenser 20 in which a condenser vacuum is maintained. The condenser 20 includes an inlet 40, a condenser body 50 and a hotwell 60. The steam turbine discharge enters the condenser 20 through the inlet 40 and proceeds to flow through an interior of the condenser body 50 where it is conditioned and cooled. As the steam turbine discharge is conditioned and cooled in the condenser body 50, it is condensed and collects as liquid water in the hotwell 60 and becomes available for further use in the power plant 10.

Generally, the normal conditions refer to those periods during which the power plant 10 is in the active state. When the power plant 10 is in the shut down state, however, steam turbine discharge continues to enter the condenser 20 and, in order to maintain ready-start conditions that enable the power plant 10 to exhibit the fast start-up characteristics, the condenser vacuum still needs to be maintained. As such, it is necessary to continue to condense steam turbine discharge within the condenser body 50 even while the power plant 10 is shut down.

A first cooling member 80 is disposed within the condenser body 50 and is configured to cool the steam turbine discharge during at least a first cooling operation, such as the maintenance of the ready-start conditions. Similarly, a second cooling member 90 is also disposed within the condenser body 50 and is configured to cool the steam turbine discharge during a second cooling operation, such as operation of the power plant 10 in the active state.

The first and second cooling members 80 and 90 are each positioned within the condenser body 50 such that the steam turbine discharge comes into contact with their respective surfaces. In addition, the first and second cooling members are each independently receptive of first and second supplies of coolant, such as water, respectively. Thus, as steam turbine discharge proceeds through the condenser body 50 and contacts the surfaces of the first and second cooling members 80 and 90, heat is removed from the steam turbine discharge by the coolant supplied to the first and second cooling members 80 and 90. The steam turbine discharge is thereby condensed and forms the liquid water which collects in the hotwell 60.

As shown in FIG. 1, the first cooling member 80 may be disposed within the condenser body 50 at a position which is upstream from a position of the second cooling member 90. However, this arrangement is merely exemplary and it is understood that the first cooling member 80 may also be disposed downstream from the second cooling member 90 or, in accordance with another embodiment, the first and second cooling members 80 and 90 may overlap with one another as long as they remain independently receptive of the first and second supplies of the coolant.

The condenser body 50 may also include a dummy member 70. The dummy member 70 is generally disposed upstream from the first and second cooling member 80 and 90 and is configured to condition and/or initially cool the steam turbine discharge. With its upstream location, the dummy member 70 serves to protect the first and second cooling members 80 and 90 from damage resulting from contact with, e.g., very hot steam turbine discharge, discharge from a steam bypass system and/or any other dangerous matter entering the condenser body 50.

The dummy member 70 and the first and second cooling members 80 and 90 each comprise a plurality of tubes 71, 81 and 91, respectively, which can be arranged in similar and/or varied formations relative to one another. That is, the dummy member 70 may include a set of horizontally arrayed tubes, the first cooling member 80 may include a set of vertically and horizontally aligned tubes and the second cooling member 90 may include a set of vertically and horizontally staggered tubes. The tubes are generally hollow and, at least in the case of the first and second cooling members 80 and 90, define interiors in which the first and second coolant supplies are to be received. In accordance with embodiments of the invention, the tubes of the first cooling member 80 include ready condition hold tubes, and the tubes of the second cooling member 90 include main cooling water tubes.

When the power plant 10 is in the shut down state, an amount of the steam turbine discharge entering the condenser 20 is relatively greatly reduced from the amount entering the condenser 20 during the active state of the power plant 10. Thus, a size of the first cooling member 80 may be significantly smaller than that of the second cooling member 90. Similarly, an amount of the first coolant supply need not be equal to that of the second coolant supply and is, in fact, significantly smaller. As such, power required to supply the first cooling member 80 with the first coolant supply is correspondingly reducible.

That is, in accordance with embodiments, a size of the first cooling member 80 is sufficient to be adequate for cooling steam during the steam turbine shut down state with relatively good water distribution and with a pump of complimentary size offering considerable power savings over a main coolant pump.

In accordance with a further aspect of the invention, the power plant may further include a coolant source 100 and a system whereby the first and second coolant supplies are deliverable to the first and second cooling members 80 and 90. The coolant source 100 provides for a supply of the coolant from which the first and second coolant supplies are drawn. In this way, the coolant source 100 may include a cooling tower, a shown in FIG. 1, or a trough source, such as a lake, a river or an ocean.

In further embodiments, the system may include a first pump 110 and/or a second pump 120 along with first and/or second piping 130 and 135. The first pump 110 is coupled to the coolant source 100 and, via optional valve 150, to the first cooling member 80. With this arrangement, the first pump 110 is configured to pump the first coolant to the first cooling member 80 during at least the first cooling operation. The second pump 120 is coupled to the coolant source 100 and, via optional valve 151, to the second cooling member 90 and is configured to pump the second coolant to the second cooling member 90 during the second cooling operation. The first piping 130 is jointly and/or separately coupled to the first and second cooling members 80 and 90 and to the coolant source 100 and is configured to return the coolant to the coolant source 100. The second piping 135 is jointly and/or separately coupled to the coolant source 100 and to the first and second pumps 110 and 120 and is configured to transport the coolant from the coolant source 100 to the pumps 110 and 120.

The second pump 120 has a larger capacity than the first pump 110 and is therefore employed during the activate state of the power plant 10 to pump the second supply of the coolant to the second cooling member 90. The first pump 110, on the other hand, requires less power to operate than the second pump. Thus, by using the first pump 110 to pump the first coolant supply to the first cooling member 80, the condenser vacuum can be maintained with the power plant 10 shut down at a reduced operating cost.

Figure 2:
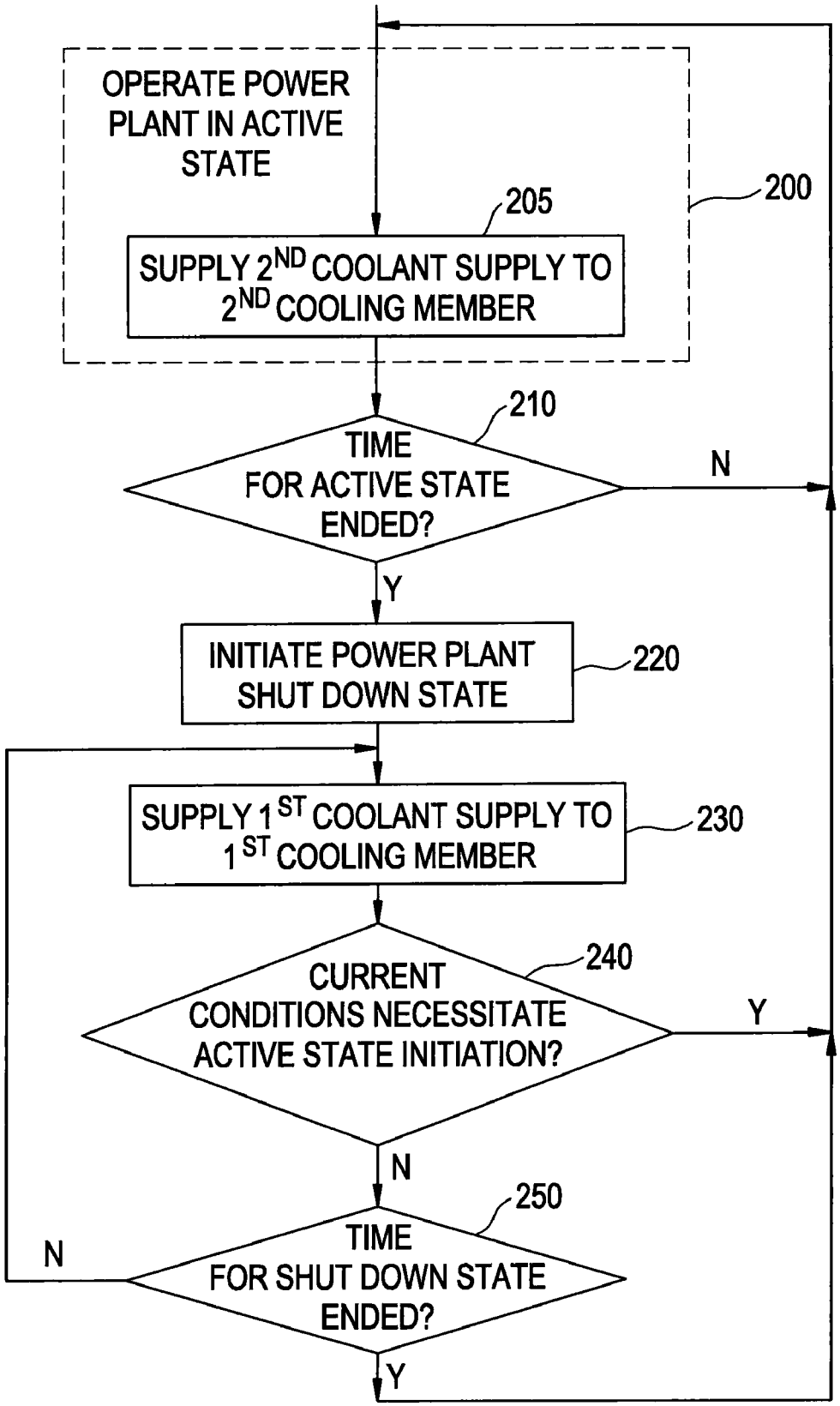
FIG. 2 is a flow diagram illustrating a method of operating a combined cycle power plant.

With reference to FIG. 2, and in accordance with another aspect of the invention, a method of operating a power the plant 10, including a condenser body 50 through which steam turbine discharge is able to flow is provided. The method includes supplying a first coolant to a first cooling member 80, which is disposed within the condenser body 50, to cool the steam turbine discharge during at least a first cooling operation, supplying a second coolant to a second cooling member 90, which is disposed within the condenser body 50, to cool the steam turbine discharge during a second cooling operation, timing a duration of each of the first and second cooling operations and alternating an engagement of the first and second cooling operations in accordance with the timing, preselected scheduling and current conditions.

That is, as shown in FIG. 2, the powerplant 10 may be operated in cycles of shut down and active states with the active state being in effect, for example, 5 days per week and 16 hours per day on those active days. As such, the power plant 10 may be understood as, at some point, initially operating in the active state (operation 200) during which the second coolant is supplied to the second cooling member 90 (operation 205). Once the time for the active state is determined to have ended (operation 210), the power plant 10 shut down state is initiated (operation 220) and, for the duration of the shut down state, the first coolant supply is supplied to the first cooling member 80 (operation 230). During the shut down state, if current conditions, such as an instance of unexpected power reduction or loss of a wind turbine or solar power source or other power source subject to uncontrolled power reductions, or some other alternate power generating apparatus, necessitates that the power plant 10 be returned to the active state (operation 240), control returns to operation 200.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A condenser, comprising:

a body into and through which steam turbine discharge is able to flow; and first and second cooling members disposed in the body, wherein the first and second cooling members are each independently receptive of first coolant pumped by a first pump and second coolant pumped by a second pump, respectively, the second pump having a larger capacity and a larger power requirement than the first pump, the first cooling member, being receptive of the first coolant, is configured to cool the discharge during at least a first cooling operation, and the second cooling member, being receptive of the second coolant, is configured to cool the discharge during a second cooling operation.

2. The condenser according to claim 1, wherein the first cooling member is disposed upstream from the second cooling member.

3. The condenser according to claim 2, further comprising a dummy member, disposed in the body and upstream from the first cooling member, which is configured to condition the discharge.

4. The condenser according to claim 1, wherein the dummy member and the first and second cooling members each comprise a plurality of tubes.

5. The condenser according to claim 4, wherein the plurality of the tubes of the first cooling member comprise ready condition hold tubes, and the plurality of the tubes of the second cooling member comprise main cooling water tubes.

6. The condenser according to claim 1, wherein an amount of the first coolant is less than that of the second coolant.

7. The condenser according to claim 1, wherein the first and second cooling operations are conducted during power plant shut down cycles and active power plant cycles, respectively.

8. The condenser according to claim 1, wherein an amount of the discharge to be cooled during the first cooling operation is less than that of the second cooling operation.

9. A power plant operable in a shut down state and an active state, comprising:

a condenser body, into and through which steam turbine discharge is able to flow and in which first and second cooling members are disposed, the first and second cooling members each being independently receptive of first and second coolant, respectively, and configured to respectively cool the steam turbine discharge during at least a first cooling operation associated with the shut down state and a second cooling operation associated with the active state;

a coolant source;

a first pump, coupled to the coolant source and the first cooling member, which is configured to pump the first coolant to the first cooling member during at least the first cooling operation; and a second pump, coupled to the coolant source and the second cooling member, which has a larger capacity and a larger power requirement than the first pump and is configured to pump the second coolant to the second cooling member during the second cooling operation.

10. The power plant according to claim 9, wherein the coolant source comprises a cooling tower.

11. The power plant according to claim 9, wherein the coolant source comprises a trough source.

12. The power plant according to claim 9, further comprising first piping coupled to the first and second cooling members and to the coolant source.

13. The power plant according to claim 9, further comprising first piping separately coupled to the first and second cooling members and to the coolant source.

14. The power plant according to claim 9, further comprising second piping coupled to the coolant source and to the first and second pumps.

15. The power plant according to claim 9, further comprising second piping separately coupled to the coolant source and to the first and second pumps.

16. A method of operating a power plant, including a condenser body through which steam turbine discharge is able to flow, the method comprising:

operating a first pump to supply a first coolant to a first cooling member disposed within the condenser body to cool the steam turbine discharge during at least a first cooling operation;

operating a second pump, which has a larger capacity and a larger power requirement than the first pump, to supply a second coolant to a second cooling member disposed within the condenser body to cool the steam turbine discharge during a second cooling operation;

timing a duration of each of the first and second cooling operations; and alternating an engagement of the first and second cooling operations in accordance with the timing, preselected scheduling and current conditions.

17. The method according to claim 16, wherein the second cooling operation is engaged 5 days each week for 16 hours each day.

18. The method according to claim 17, wherein the second cooling operation is additionally engaged as required by the current conditions.

19. The condenser according to claim 1, wherein the first pump is operated during a power plant shut down state and the second pump is operated during a power plant active state.

20. The method according to claim 16, wherein the operating of the first pump is conducted during a shut down state of the power plant and the operating of the second pump is conducted during an active state of the power plant.

* * * * *